US009791245B1

(12) United States Patent
Lamore

(10) Patent No.: US 9,791,245 B1
(45) Date of Patent: Oct. 17, 2017

(54) BUILDING PROTECTION BARRIER SYSTEM

(71) Applicant: Michael John Lamore, Greensboro, NC (US)

(72) Inventor: Michael John Lamore, Greensboro, NC (US)

( * ) Notice: Subject to any disclaimer, the term of this patent is extended or adjusted under 35 U.S.C. 154(b) by 229 days.

(21) Appl. No.: 14/575,031

(22) Filed: Dec. 18, 2014

Related U.S. Application Data

(60) Provisional application No. 61/917,732, filed on Dec. 18, 2013.

(51) Int. Cl.

| | |
|---|---|
| ***E04H 17/16*** | (2006.01) |
| ***E04H 17/18*** | (2006.01) |
| ***E06B 11/02*** | (2006.01) |
| ***F41H 5/24*** | (2006.01) |
| ***E04H 9/06*** | (2006.01) |
| ***E04H 9/14*** | (2006.01) |
| ***E04B 1/94*** | (2006.01) |
| ***E04B 1/98*** | (2006.01) |
| ***E06B 5/12*** | (2006.01) |

(52) U.S. Cl.
CPC ..... *F41H 5/24* (2013.01); *E04B 1/94* (2013.01); *E04B 1/98* (2013.01); *E04H 9/06* (2013.01); *E04H 9/14* (2013.01); *E06B 5/12* (2013.01); *E04H 17/16* (2013.01); *E04H 17/18* (2013.01)

(58) Field of Classification Search
CPC .... E04H 9/00; E04H 9/04; E04H 9/06; E04H 9/10; E04H 17/00; E04H 17/16; E04H 17/165; E04H 9/14; E06B 11/02; E06B 5/12; E04F 13/075; E04F 13/08; E04F 13/00; F41H 5/24; E04B 1/94; E04B 1/98
USPC ..... 256/32, 47, 52, 25, 26, 31; 404/6, 9, 10; 52/144, 1, 506.01, 232
See application file for complete search history.

(56) References Cited

U.S. PATENT DOCUMENTS

| | | | |
|---|---|---|---|
| 156,238 | A | 10/1874 | Squyer |
| 319,112 | A | 6/1885 | Nevius |
| 1,652,186 | A | 8/1922 | Strauss |

(Continued)

FOREIGN PATENT DOCUMENTS

| | | | |
|---|---|---|---|
| FR | 2792014 | A1 | 10/2000 |

OTHER PUBLICATIONS

Cable Organizer.com, "Yellow Jacket Cable Protector—Extra Heavy Duty Protection," http://cableorganizer.com/cable-protector-yjack/, pp. 1-4, Feb. 6, 2005.

*Primary Examiner* — Phi A
(74) *Attorney, Agent, or Firm* — Additon, Higgins & Pendleton, P.A.

(57) ABSTRACT

A barrier system prevents entry through a structure and includes a first door positioned across an opening in the structure on a first side of the structure and a second door positioned across the opening on a second side of the structure. A protection fabric extends over the second door such that the protection fabric is between the first door and the second door, wherein the protection fabric comprises at least one attachment eyelet along at least one edge of the protection fabric to attach the protection fabric to the structure. The protection fabric has cables that terminate in a series of the eyelets. The eyelets attach to stanchions mounted on a foundation and dissipate the force of impact of a projectile hitting the structure along the protection fabric and the stanchions.

49 Claims, 16 Drawing Sheets

(56) References Cited

U.S. PATENT DOCUMENTS 1,848,516 A 3/1932 Davison
2,192,369 A 7/1938 Sparrow
2,826,840 A 3/1958 Cooper et al.
2,957,657 A 10/1960 Frieder et al.
3,058,703 A 10/1962 Fonden et al.
3,722,140 A 3/1973 Newton
3,748,782 A 7/1973 Reynolds
3,974,313 A 8/1976 James
4,023,819 A 5/1977 Holman, Jr.
4,332,503 A 6/1982 Hurst, Jr.
4,449,562 A * 5/1984 Leivenzon ..... E06B 9/58 160/113
4,502,812 A 3/1985 Zucker
4,567,851 A 2/1986 Larsen
4,576,507 A * 3/1986 Terio ..... E01F 13/046 404/6
4,780,020 A * 10/1988 Terio ..... E01F 13/048 404/6
4,824,282 A * 4/1989 Waldecker ..... E01F 13/046 404/6
4,844,653 A 7/1989 Dickinson
4,878,314 A * 11/1989 Blockinger ..... G08B 13/04 109/49.5
4,921,033 A * 5/1990 Finch ..... E06B 9/13 160/133
4,989,835 A 2/1991 Hirsh
5,066,165 A 11/1991 Wofford et al.
5,076,168 A * 12/1991 Yoshida ..... F42D 5/05 102/303
5,192,159 A 3/1993 Higginson
5,267,367 A 12/1993 Wegmann, Jr.
5,459,963 A 10/1995 Alexander
5,740,629 A 4/1998 Fischer et al.
5,762,443 A 6/1998 Gelfand et al.
5,833,413 A * 11/1998 Cornelius ..... B60P 7/14 410/118
5,987,816 A 11/1999 Fischer et al.
6,015,003 A * 1/2000 Switzgable ..... E05D 1/04 16/355
6,176,050 B1 * 1/2001 Gower ..... E04H 9/14 135/115
6,382,869 B1 5/2002 Dickinson
6,393,731 B1 5/2002 Moua et al.
6,471,197 B1 10/2002 Denk et al.
6,702,533 B1 * 3/2004 Williams ..... B60P 7/0876 410/118
6,843,613 B2 1/2005 Gelfand et al.
6,845,589 B1 1/2005 Thompson et al.
6,857,227 B2 2/2005 Russell
6,860,678 B2 3/2005 Gunter
6,896,443 B1 * 5/2005 Ousterhout ..... E01F 13/12 256/13.1
6,942,419 B2 9/2005 Knak et al.
6,997,036 B2 2/2006 Kojima et al.
7,060,901 B2 6/2006 Herzog et al.
7,083,357 B2 8/2006 Lamore
7,140,802 B2 11/2006 Lamore
7,195,419 B2 3/2007 Gelfand
7,210,873 B2 5/2007 Gelfand
7,332,672 B2 2/2008 Henry
7,377,716 B2 5/2008 Gelfand
7,441,983 B2 10/2008 Gelfand
7,467,909 B2 12/2008 Orner, Jr. et al.
7,484,905 B2 2/2009 Gelfand et al.
7,530,759 B2 5/2009 Gelfand et al.
7,641,416 B2 1/2010 Miracle
7,785,031 B2 8/2010 Vellozzi et al.
7,918,167 B2 * 4/2011 Tanielian ..... E01F 13/12 102/303
7,964,796 B2 6/2011 Suzuki
7,984,591 B2 7/2011 Cashin et al.
8,043,024 B2 10/2011 Lamore
9,017,190 B2 * 4/2015 Hulbert ..... A63B 71/022 473/415
2002/0182007 A1 12/2002 Yodock et al.
2003/0016996 A1 1/2003 Gelfand et al.
2007/0237577 A1 10/2007 Gelfand et al.
2007/0258761 A1 11/2007 Orner, Jr. et al.
2008/0073633 A1 3/2008 Gelfand
2008/0075529 A1 3/2008 Gelfand et al.
2009/0116904 A1 5/2009 Gelfand et al.
2009/0185857 A1 7/2009 Gelfand et al.
2010/0275515 A1 11/2010 Gelfand et al.
2011/0013991 A1 * 1/2011 Watson ..... E21F 17/103 405/284
2011/0056365 A1 * 3/2011 Coddens ..... E06B 5/12 89/36.04
2014/0262071 A1 * 9/2014 Colson ..... E06B 9/303 160/133
2016/0247372 A1 * 8/2016 Sylvester ..... E05G 1/10

* cited by examiner

BUILDING PROTECTION BARRIER SYSTEM

CROSS REFERENCE TO RELATED APPLICATIONS

This application claims priority to and incorporates entirely by reference U.S. Provisional Patent Application Ser. No. 61/917,732, filed on Dec. 18, 2013, and entitled Protection Barrier.

FIELD OF INVENTION

The present invention relates generally to protection barriers, and more particular, to barriers for protecting equipment, buildings, and infrastructure from projectiles, explosives, airborne debris, or missiles.

BACKGROUND OF THE INVENTION

Airborne debris or objects projected from tornadoes, hurricanes, explosives and other forces, i.e., projectiles or missiles, can cause significant damage to equipment, buildings, infrastructure and other facilities. Critical infrastructure, buildings, equipment, and other facilities and structures may need barriers to stop projectiles from striking them and causing damage. In particular, when a structure has been damaged along an opening used for ingress and egress, significant problems occur in terms of access to items on opposite sides of the structure. A need exists for a barrier system that includes a sacrificial component absorbing the impact of an incoming projectile under force and a secure component that still protects the structure while allowing passage through an opening in the structure. In other words, a need exists for a two door system in which an outer door is equipped to take the impact and an inner door is protected to maintain a functional way to open and close the structure.

SUMMARY OF THE INVENTION

A barrier system prevents entry through a structure, and the system includes a first door positioned across an opening in the structure and on a first side of the structure and a second door positioned across the opening on a second side of the structure to define a separation between the first door and the second door. A protection fabric extends over the second door such that the protection fabric is between the first door and the second door, wherein the protection fabric comprises at least one attachment eyelet along at least one edge of the protection fabric to attach the protection fabric to the structure.

In another embodiment, a barrier system positioned across an opening in a structure includes at least a first stanchion defining at least one peg extending from the stanchion and a protective fabric extending across the opening. The protective fabric is connected to the first stanchion by an eyelet attached to a first edge of the protective fabric, and the protective fabric is also attached to the structure at a second edge of the protective fabric opposite the first edge.

In yet another embodiment, a barrier system includes a first stanchion defining at least one peg extending from said first stanchion and a second stanchion defining at least one opposite peg extending from said second stanchion. A protective fabric extends between the first and second stanchions. The protective fabric includes at least one eyelet along at least one edge of the protective fabric, wherein the protective fabric is connected to both stanchions, and wherein the protective fabric is connected to at least one of said stanchions by the eyelet engaging either the peg or the opposite peg.

BRIEF DESCRIPTION OF THE DRAWINGS

Other objects, advantages, and applications of the present invention will become more apparent upon examination of the drawings wherein like numerals refer to like elements throughout.

DETAILED DESCRIPTION OF THE PREFERRED EMBODIMENT

Figure 1:
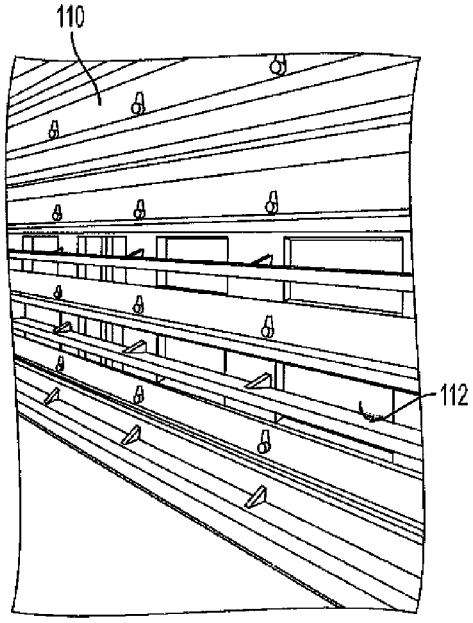
FIG. 1 is a perspective view of a first door according to embodiments of the system disclosed herein.

The present invention will be described more fully hereinafter with reference to the accompanying drawings, in which some, but not all embodiments of the invention are shown. The invention may be embodied in other forms and should not be construed as limited to the embodiments herein. Like numbers refer to like elements throughout.

The present invention provides a barrier that protects buildings and other structures from impacts or breaches by projectiles or missiles of various types and sizes projected at various velocities from tornadoes, hurricanes, explosives and other forces giving the projectiles sufficient power to damage the structure. The barrier may protect buildings or any kind of structure (i.e., fences, barricades, or even gated paths) from projectiles traveling toward the structures from various directions, at varying heights, and/or from various angles. The overall assembly of the barrier may be any height and width needed to protect a particular structure.

The barrier may be installed outside of the equipment, buildings, infrastructure, doors, openings, and other locations requiring protection, at a setback distance that prevents projectile from causing damage. The barrier, or portions thereof, may be fastened to a pivoting or sliding support frame that allows opening and closing of projectile barrier for access to a building or other structure.

The barrier may be installed at setback distance from the equipment, buildings, infrastructure and other facilities for protection. The setback distance may be from about 1 to 5, 10, 15, 20, 25, 30, 35, 40, 45, or 50 feet depending on projectile type and velocity expected. Thus, the setback distance may be greater than 5, 10, 15, 20, 25, 30, 35, 40, 45, or even 50 feet. In a typical embodiment the setback distance is between about 1 and 30 feet or more typically between about 5 and 20 feet. The barrier stops various sizes of projectiles or airborne debris resulting from tornadoes, hurricanes, explosives and other forces. Projectiles may vary in size from solid spheres about 1 inch in diameter to large projectiles such as cars or planes. Projectile impact velocities may exceed 140 miles per hour. Projectile barrier height may be up to 20, 30, 40, or 50 feet of height or greater and up to 20, 30, 40, or 50 feet of width or greater to protect against projectile impacts from various directions, such as a horizontal direction or a vertical direction, and from various heights and from various angles.

In one embodiment, the barrier includes at least one layer of a net-like material. The net-like material may be high-strength, light-weight cables and/or straps connected in a grid pattern. The spacing between the cables may vary from about 1 to about 48 inches. The cables and/or straps may be oriented generally horizontally and vertically with respect to the ground or may be oriented at an angle such as about 10, 20, 30, 40, 50, 60, 70, or 80 degrees from the horizontal or vertical. The horizontal cable members may have large loops or eyelets on each end that grab the steel support structure if one or more projectile impacts occur. In addition to high-strength, light-weight cables connected in a grid pattern to form a net-like material, the net-like material may comprise wire mesh, such as fencing material. The net-like material may be made of Kevlar, metal, such as steel, stainless steel, or metal alloys. The net-like material is mounted on a rigid structure. High-strength cables may be mounted to the rigid structure to provide reinforcement to the net-like material when the net-like structure is impacted by a projectile. In another embodiment, the barrier may include one or more steel plates connected to the net-like layer to stop relatively small projectiles.

In another embodiment, the barrier encompasses a plurality of layers of net-like material. The net-like material may be high-strength, light-weight cables connected in a grid pattern. The spacing between the cables may vary from about 1 to about 48 inches. The cables may be oriented generally horizontally and vertically with respect to the ground or may be oriented at an angle such as about 10, 20, 30, 40, 50, 60, 70, or 80 degrees from the horizontal or vertical. The horizontal cable members may have large loops or eyes on each end that grab the steel support structure if one or more projectile impacts occur. In addition to high-strength, light-weight cables connected in a grid pattern to form a net-like material, the net-like material may comprise wire mesh, such as fencing material. The net-like material may be made of Kevlar, metal, such as steel, stainless steel, or metal alloys. In another embodiment, the barrier may include one or more steel plates to stop relatively small projectiles. High-strength cables may be mounted to the rigid structure to provide reinforcement to the net-like material when the net-like structure is impacted by a projectile. In another embodiment, the barrier may include one or more steel plates connected to the net-like layer to stop relatively small projectiles.

In yet another embodiment, the barrier includes at least two layers of net-like material, at least a first layer and a second layer. The first layer comprises cables connected in a grid pattern wherein the cables are spaced a first distance (e.g., about 0.25, 0.50, 0.75, 1.0, 1.25, 1.5, 1.75, 2.0, 2.25, 2.5, 2.75, 3.0, 3.5, 4.0, 4.5, 5.0, 6.0, 7.0, 8.0, 9.0, 10.0, 11.0, 12.0, 24.0, or 48.0 inches or between about 0.25 inches and about 48.0 inches) from each other cable. The second layer comprises cables connected in a grid pattern wherein the cables are spaced a second distance (e.g., about 0.25, 0.50, 0.75, 1.0, 1.25, 1.5, 1.75, 2.0, 2.25, 2.5, 2.75, 3.0, 3.5, 4.0, 4.5, 5.0, 6.0, 7.0, 8.0, 9.0, 10.0, 11.0, or 12.0 inches or between about 0.25 inches and 12.0 inches) from each other cable. The first distance and the second distance between the cables may be equal or different from each other. Thus, the first layer may comprise cables having a grid spacing of about 1.0 inches and the second layer may comprise cables having a grid spacing of about 2.0 inches. Additionally, the spacing between the cables extending horizontally may be the same as the spacing between the cables extending vertically so that the grid openings in the first and/or second layer have sides of about equal length. Alternatively, the spacing between the cables extending horizontally may be different from the spacing between the cables extending vertically so that the grid openings in the first and/or second layer have sides of unequal length. The layers may be configured so that the openings are generally square-shaped. Alternatively, the layers may be configured so that the openings have other shapes such as circular, rectangular, hexagonal, and octagonal. The openings in the layers need not be limited to any particular shape. The first layer may be positioned between the structure to be protected and the second layer. Alternatively, the second layer may be positioned between the structure to be protected and the first layer. The first layer may comprise high-strength, lightweight cables and the second layer may comprise mesh or fencing made of metal.

In a further embodiment, the barrier includes at least three layers of net-like material, at least a first layer, a second layer and a third layer. The first layer has cables connected in a grid pattern wherein the cables are spaced a first distance (e.g., about 0.25, 0.50, 0.75, 1.0, 1.25, 1.5, 1.75, 2.0, 2.25, 2.5, 2.75, 3.0, 3.5, 4.0, 4.5, 5.0, 6.0, 7.0, 8.0, 9.0, 10.0, 11.0, or 12.0 inches or between about 0.25 inches and 12.0 inches) from each other cable. The second layer comprises cables connected in a grid pattern wherein the cables are spaced a second distance (e.g., about 0.25, 0.50, 0.75, 1.0, 1.25, 1.5, 1.75, 2.0, 2.25, 2.5, 2.75, 3.0, 3.5, 4.0, 4.5, 5.0, 6.0, 7.0, 8.0, 9.0, 10.0, 11.0, or 12.0, 24.0 or 48.0 inches or between about 0.25 inches and 48.0 inches) from each other cable. The third layer includes cables connected in a grid pattern wherein the cables are spaced a second distance (e.g., about 0.25, 0.50, 0.75, 1.0, 1.25, 1.5, 1.75, 2.0, 2.25, 2.5, 2.75, 3.0, 3.5, 4.0, 4.5, 5.0, 6.0, 7.0, 8.0, 9.0, 10.0, 11.0, 12.0, 24.0 or 48.0 inches or between about 0.25 inches and 48.0 inches) from each other cable. The first distance and the second distance between the cables of the first, second and third layers may be equal or different from each other. Thus, the first layer may have cables with a grid spacing of about 1.0 inches, the second layer may have cables having a grid spacing of about 2.0 inches, and the third layer may comprise cables having a grid spacing of about 3.0 inches. Additionally, the spacing between the cables extending horizontally may be the same as the spacing between the cables extending vertically so that the grid openings in the first and/or second layer have sides of about equal length. Alternatively, the spacing between the cables extending horizontally may be different from the spacing between the cables extending vertically so that the grid openings in the first, second, and or third layer have sides of unequal length. The layers may be configured so that the openings are generally square-shaped. Alternatively, the layers may be configured so that the openings have other shapes such as circular, rectangular, hexagonal, or octagonal. The openings in the layers need not be limited to any particular shape. The layers may be positioned in any order in relation to the structure being protected. For example, beginning with the position closest to the structure to be protected the layers may be positioned in the following order; first, second and third layers; first, third and second layers; third, second, and first layers; or second, first, or third layers may be positioned between the structure to be protected and the second layer.

When the barrier includes two or more net-like layers, each layer will typically have different size openings to block and absorb impacts from different size projectiles. For example, one layer may have openings that are about 0.5 inches by 0.5 inches to block and/or absorb the impact of small projectiles that are about 0.6 inches in diameter or larger, a second layer may have openings that are about 4.0 inches by about 4.0 inches to block and/or absorb the impact of projectiles that are about 4.0 inches in diameter or larger, and a third layer having openings about 48.0 inches by about 48.0 inches to block and/or absorb the impact of large projectiles such as a vehicle or plane.

One or more of the side edges of one or more of the layers of net-like material are attached to a rigid support structure. The side edges may be releasably attached or securely attached to the support structure. Alternatively, one or more of the side edges of one or more of the plurality of layers of net-like material may be attached to the support structure so that the side edges grab or tighten against the support structure upon impact by a projectile or projectiles.

Figure 2:
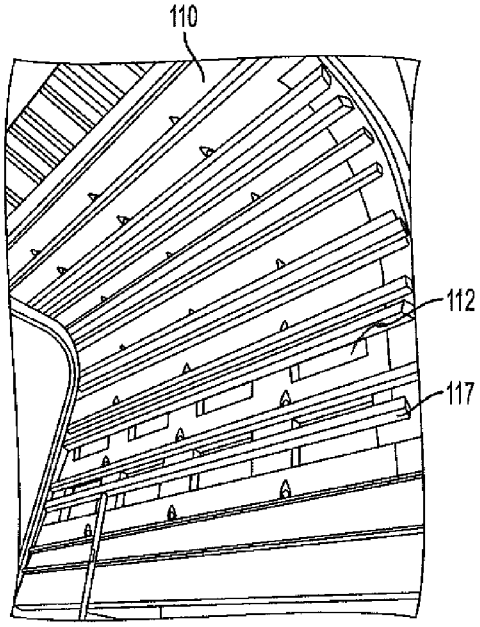
FIG. 2 is a perspective view of a first door in a closing motion according to embodiments of the system disclosed herein
Figure 3:
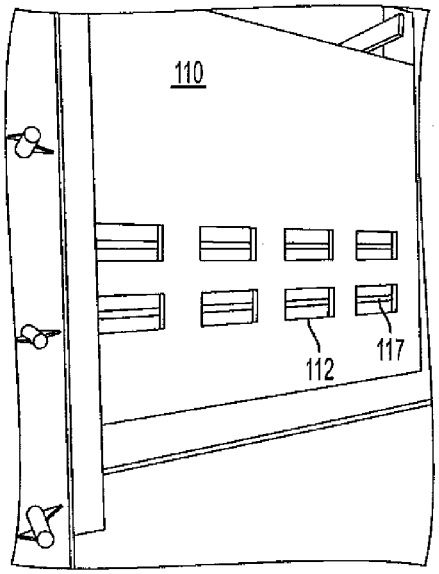
FIG. 3 is a perspective view of the first door of FIG. 1 according to embodiments of the system disclosed herein

In one embodiment of the present invention a structure (50) is to be protected, e.g., a building, has structural walls with a nonstructural rollup door (110) that is subject to impacts by projectiles, where contents inside building would be damaged if a projectile strikes and passes through nonstructural rollup door (110). Furthermore, rollup door (110) would be inoperable if impacted by projectile and contents inside would be inaccessible. In the illustrated embodiment of FIGS. 1-3, the roll up door is on an interior side of a structure, or building. As shown in perspective view in FIG. 13, the roll up door (110) is on one side of a structure (50), such as a building or any other structural component. Vertical steel end supports, referred to herein as stanchions (210A, 210B) with lateral bracing are embedded in a reinforced concrete foundation (207), and are connected with horizontal steel bracing overhead. In the ultimate construction, the movable barrier section has a pivoting side configured on stanchion (210B) and a locking side configured on stanchion (210A), where movable barrier can swing open along radius where hinges allow for pivoting.

Figure 18:
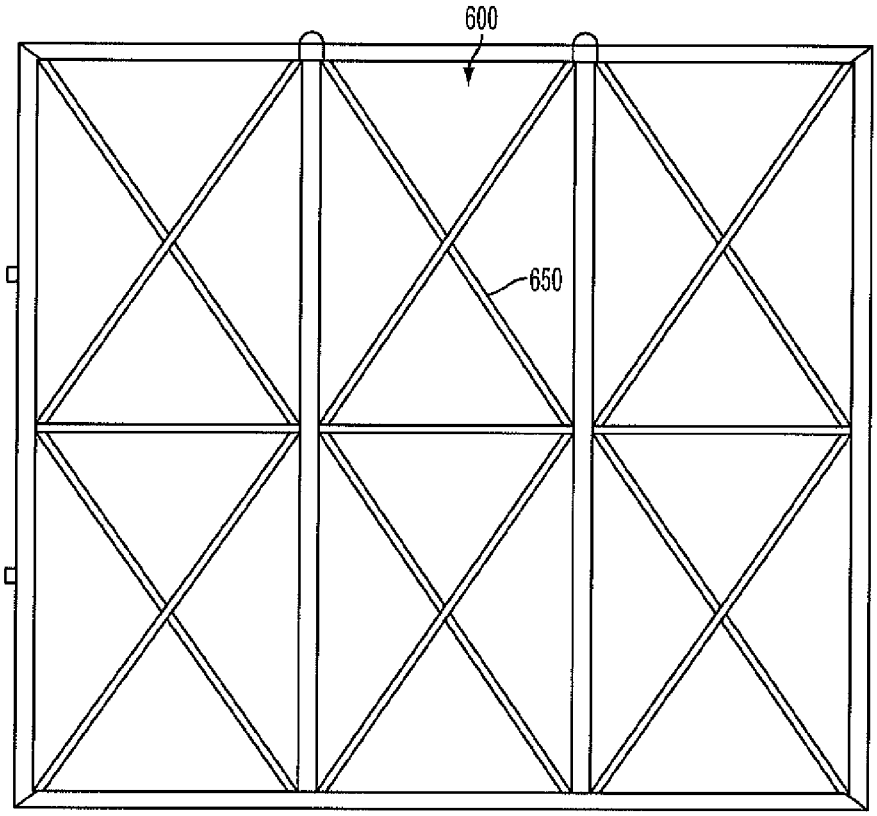
FIG. 18 is a plan view of an outer or second door of the barrier system described herein.

As shown generally at FIG. 18, the barrier system of this disclosure attaches an outer or second door (600) to the pivoting side stanchion (210B) as shown in FIG. 18 as a front elevation view of the second door (600), also referred to herein as the barrier support structure, including the diagonal steel bracing (650) across the door that provides a level of defense from incoming projectiles. The assembly is further reinforced by rebar reinforcement in concrete foundations. Fixed horizontal bars are also structurally connected to the support structure for further reinforcement.

Figure 13:
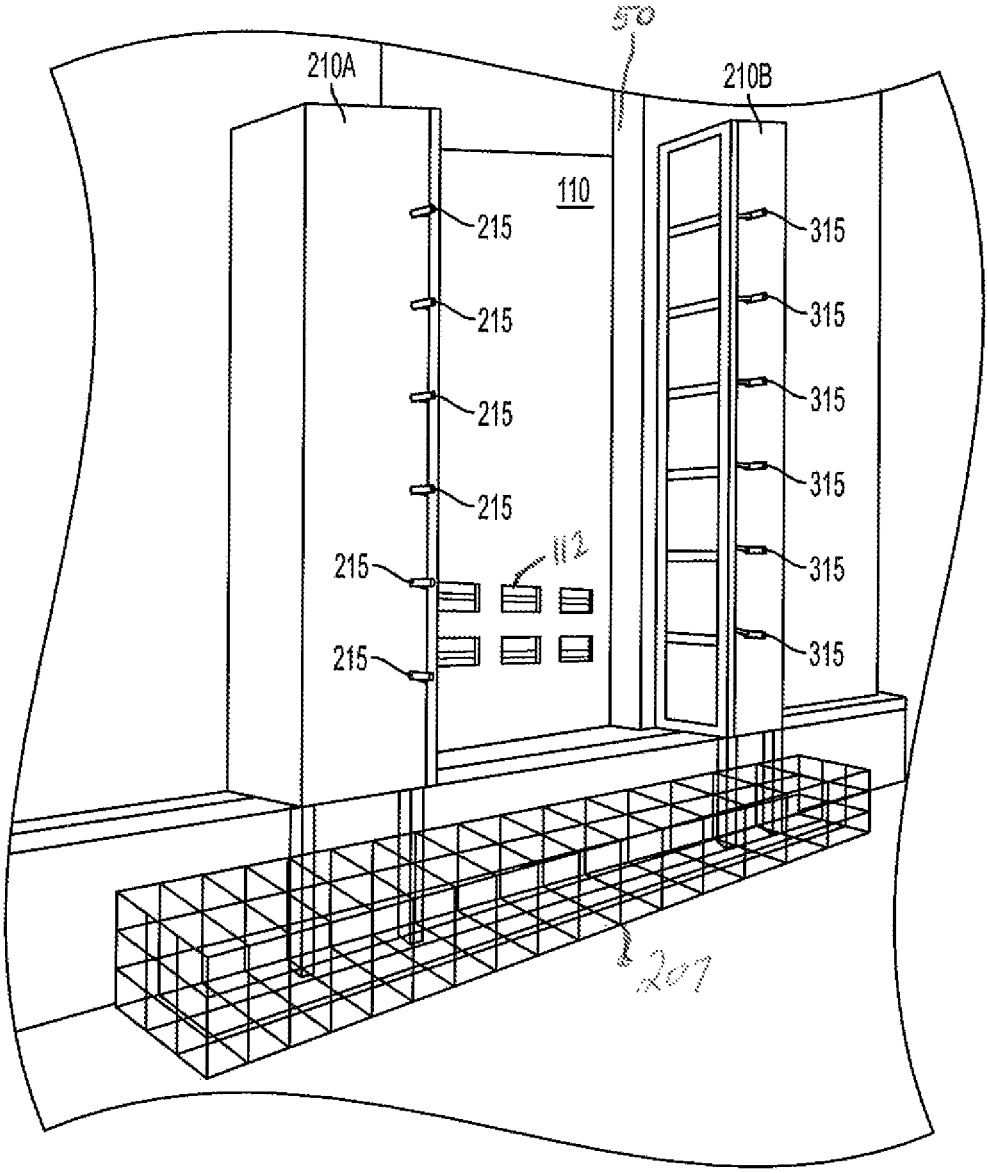
FIG. 13 is a front perspective view of a foundation and supporting stanchions about an opening of a structure having a door of FIG. 1.
Figure 26:
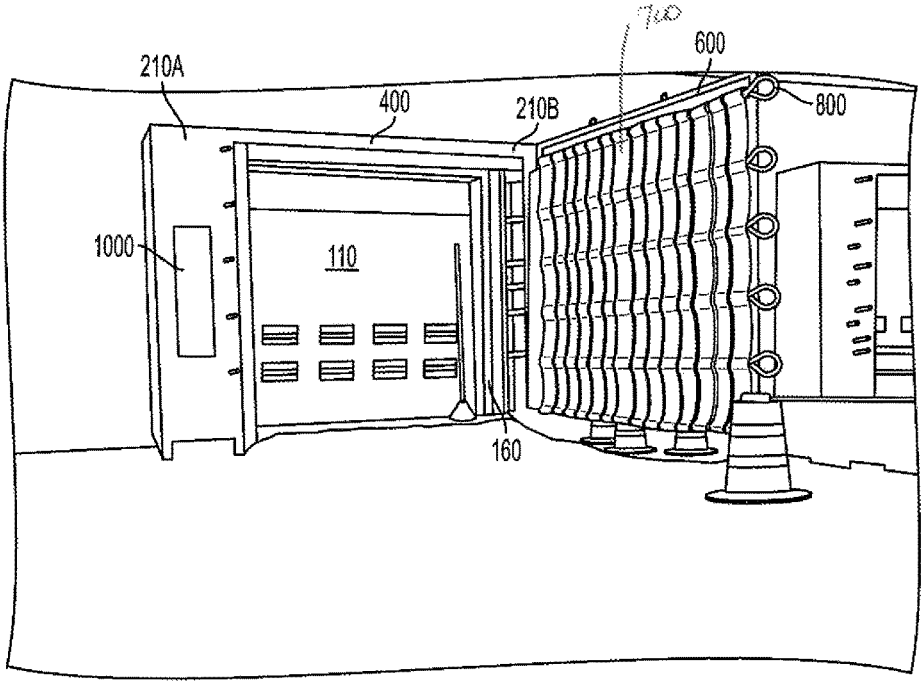
FIG. 26 is a side perspective view of a barrier system disclosed herein and installed in a structure.

The overall barrier system in full view is shown in FIGS. 13 and 26 as a support structure of stanchions (210A, 210B) positioned to hold a barrier as described herein. The system includes a first door (110) on an interior of a structure (50) with the stanchions (210A, 210B) positioned to hold an outer barrier system that includes a second or outer door (600) supporting a protective fabric (700) thereon. The stanchions (210A, 210B) are supported by appropriate structural foundation materials (207) that may be positioned underground and in poured concrete. FIGS. 26-29 illustrate the system disclosed herein having stanchions (210A, 210B), a cap (400) on the stanchions for added support and stability, an outer or second door (600), and a protective fabric (700) on the outer or second door. The outer door (600) is shown as pivoting about the pivot stanchion (210B) and latching across a latch stanchion (210A) to secure the outer door (600) closed. In one embodiment, the protective fabric (700) includes eyelets (800) on opposite edges of the protective fabric. The eyelets (800) support the outer door (600) on both the pivot side stanchion (210B) and the latch side stanchion (210A). Each of these components is set forth in detail in this Description.

As an overview beginning with FIG. 13, in one embodiment, a barrier system prevents entry through a structure (50), and the system includes a first door (110) positioned across an opening in the structure (50) and on a first side of the structure (50). A second door (600) is positioned across the opening and on a second side of the structure (50) to define a separation between the first door and the second door. A protection fabric (700) extends over the second door (600) such that the protection fabric is between the first door (110) and the second door (600), wherein the protection fabric includes at least one attachment eyelet (800) along at least one edge of the protection fabric (700) to attach the protection fabric (700) to the structure. The protection fabric (700) and associated eyelets (800) on the protection fabric may be the only portions of the barrier assembly attached to the stanchions. In other words, the system uses the protection fabric eyelets (800) to both hinge the assembly to one of the stanchions (210B) and latch the assembly to the other stanchion (210A). In this embodiment, the outer, or second, door (600) actually hangs on the protection fabric (700) and does not directly attach to the stanchions.

The combination of the protection fabric (700) and the outer, or second, door (600) hanging on the stanchions (210) provides the sacrificial component receiving any impacts from projectiles or missiles and stopping the force of impact before the projectile or missile damages the first, inner door (110).

The protection fabric (700) may include at least two eyelets (800) positioned on opposite edges of the protection fabric (700) and at least one of the eyelets (800) includes a stiffening member, such as a strip of aluminum or other reinforcement material, retaining the shape of the eyelet (800). The protection fabric (700) may be a multi-piece protective barrier having interception members (730) extending in one direction and beam members (725) extending in a substantially perpendicular direction to said interception members. The figures associated with this description show the interception members (730) as straps and the beam members (725) as cables, but this embodiment is not limiting of the components that may be used to create the protection fabric (700). In other embodiments, the interception members and the beam members are connected in a weave forming the protection fabric. As described above, the interception members and the beam members may be connected in a net configuration or any pattern that forms a barrier to projectiles. Instead of a weave or a net, in the Figures shown, the interception members (730) define respective loops (732) through which the beam members (725) extend to weave the beam members (725) (i.e., the cables) into the interception members (730) (i.e., the vertical straps). Numerous configurations are within the scope of this invention for the number of straps (730), the number of cables (725), and the spacing between the two defining openings in the protection fabric (700). In other words, the "tightness" of the protection fabric and the closeness of the protection fabric weave is variable.

The beam members (725) terminate in loops, or eyelets (800), on at least one end, and in the embodiment of the figures, the beam members terminate with an eyelet (800) on each end. It is notable that the eyelets may be formed by using continuous beam members, such as a cable having desired strength qualities, and looping the cable (725) back upon itself to form the eyelets (800) on either end of the beam members (725). For example, and without limiting the invention, the beam members (725) may be composed of high strength synthetic cables having fibrous or mesh cross sections of polymeric and/or metallic materials strands or weaves. The cable (725) can be cut open in a longitudinal direction and one end of the cable buried back into the cut open section to form a woven connection inside the single, continuous beam member (725) and resulting in the terminating loop referred to herein as an eyelet (800).

A barrier system of this description includes an assembly, or apparatus, in which the protection fabric (700) is attached to the second, or outer, door (600) by clamps (715) extending over and bolted to the beam members (725). In this embodiment, the second door (600) is a steel plate door comprising reinforcement cross members (650) of steel. The clamps (715) hold the door (600) and the protection fabric (700) together as one assembly by the clamps being bolted across the beam members (725) of the fabric and into the door (600).

The assembly of the embodiments described herein includes, therefore, a structure (50) having an opening for ingress and egress of people or equipment, and that opening is protected by a first, or inner, door that is intended to maintain functionality in the event of a projectile or missile impacting the structure with sufficient force to do significant damage. An outer door (600), equipped with protection fabric (700) takes on the impact. The outer door and protection fabric provide grades of protection by physically blocking different sizes of projectiles with stanchion assemblies (210) and the outer door (600) along with the weave of the protection fabric (700). The arrangement of the overall assembly of the barrier system described herein also has appropriate mechanisms to absorb the energy of an impact from a projectile or missile and dissipate that energy along the protection fabric (700), the beams (725) and interception members (730) of the protection fabric, the stanchions (210), and the foundation (207) outside the structure 50.

As described above and shown generally in FIG. 13, the first door (110) is a retractable or roll-up door on a track connected to the structure (50). The inside or first door (50) (i.e., the roll up door) is used in the system to ensure a manner of ingress and egress in the case of a projectile or missile damaging the outer or second door (600). In this sense, the outer door (600) and protective fabric (700) are sacrificed and take the impact of a forceful projectile to protect the functionality of the inside roll-up door. In one embodiment, the first door (110) defines pressure relief openings (112) receiving pop out panels (122) removably positioned within said pressure relief openings (112). Many of the projectiles and missiles that may impact the structure at hand and ruin the path of ingress and egress across the structure may be due to weather such as hurricanes and tornadoes. In one embodiment, therefore, in order to protect the structure (50) and its contents, the interior or first door (110) is equipped to provide pressure relief openings (112) in the event of a tornado or other severe pressure drop. Instead of allowing an associated structure or building to explode due do severe pressure differentials across the structure, and possibly leaving no access to the interior, the first or interior door (110) (i.e., the roll-up door in the figures) is equipped with pressure relief openings (112) that are fitted with pop out panels (122). The pop out panels (122) are secured across the pressure relief openings (112) in the door by an adhesive of known strength such that the panels pop loose from the first or inside door in the event of a severe pressure drop. The pop out panels are formed with a plate (122) and a lip (120) that fit across and into the pressure relief openings (112). In one embodiment, the panels (112) attach to the first door (110) by a tether, and that tethering may be accomplished by a mechanical hinge. In any construction, the panels (112) break their adhesive connection and fall out of (or at least open) the pressure relief openings (112) upon a pressure differential across the first door. The adhesive securing the panels may be engineered to release the panels when the pressure differential across the first door is greater than 5 pounds per square feet. In another embodiment, the panels open when the pressure differential across the first door is between about 5 pounds and about 30 pounds per square feet.

Outside the structure (50) at hand, a support assembly allows a second door (600) and a protective fabric (700) to take the impact of oncoming projectiles and missiles, dissipate the energy, block an oncoming projectile and protect the inner or first door (110). The second door (600) connects to the structure (50) by at least one stanchion (210), wherein the stanchion includes uprights (219) connecting at least one plate member (221) along the uprights. The stanchion includes a reinforcing post member (215) extending through a plate member (221) into the stanchion (210), and the post member defines a peg (215A) extending from the plate member (221). The post member (215) attaches to respective uprights (219) on opposite sides of the stanchion (210). The peg (215A) is supported by a first gusset (235A) connected to the plate member. A second gusset (225A) connects to the peg (215A) at an end of the peg opposite the first gusset. The stanchion connects to the exterior of the structure proximate the opening and the peg (215A) receives one of said eyelets (800) across the peg (215A) to support the protective fabric and the second door on the stanchion (210). In one embodiment, the eyelets (800) are on opposite edges of the protective fabric (700) and serve to hinge the outer, or second, door (600) on one stanchion (210B) and latch the door (600) on an opposite stanchion (210A) via the above noted gussets (235).

The stanchions, therefore, can be described as a hinging, or pivot side stanchion (210B) that has the above noted pegs (215) to form a hinging mechanism attaching the outer or second door (600) to the pivot side stanchion (210) and a latch side stanchion that allows for latching the pivoting assembly of the door (600) and protection fabric (700) that swings in a radial fashion from the pivot side stanchion (210B).

A barrier system according to the embodiments described herein, therefore, may include a first stanchion (210A) defining at least one peg (215A) extending from the first stanchion and a second stanchion (210B) defining at least one opposite peg (217A) extending from the second stanchion. A protective fabric (700) extends between the first and second stanchions, and the protective fabric includes at least one eyelet (800) along at least one edge of the protective fabric, wherein the protective fabric is connected to both stanchions, and wherein the protective fabric is connected to at least one of said stanchions by the eyelet engaging either said peg or said opposite peg.

The pegs are supported by respective first gussets (235A) connecting the pegs to a respective stanchion. Second gussets (225A) connect the pegs at an end of each respective peg opposite the respective first gussets. In one peg embodiment, the second gusset (325A) defines an opening (340) to receive an attachment mechanism connecting the second gusset to the second stanchion. In this way, the second gusset of the second opposite peg defines a latch for receiving and securing an eyelet between the attachment mechanism and second gusset. This gusset, peg, and attachment mechanism is used to hinge the protective net that actually holds up the second or outer door. Accordingly, the protective fabric includes at least first and second eyelets on opposite edges of the protective fabric, and the first eyelet engages the peg on the first stanchion and the second eyelet engages the latch on said second stanchion.

Figure 4:
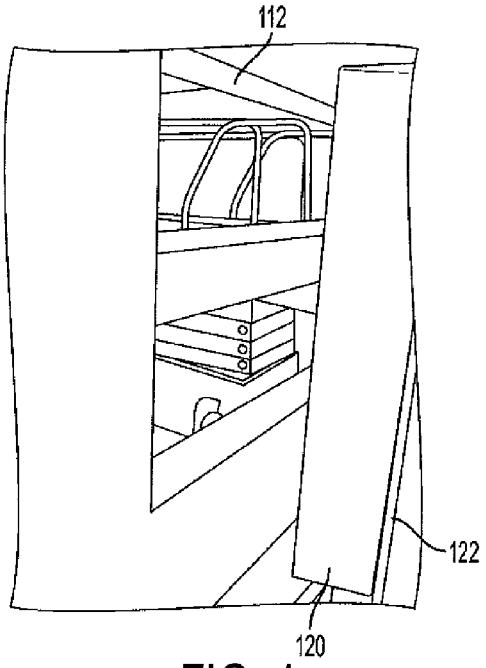
FIG. 4 is a perspective view of a pop out panel fitting within an opening in the door of FIG. 1.
Figure 5:
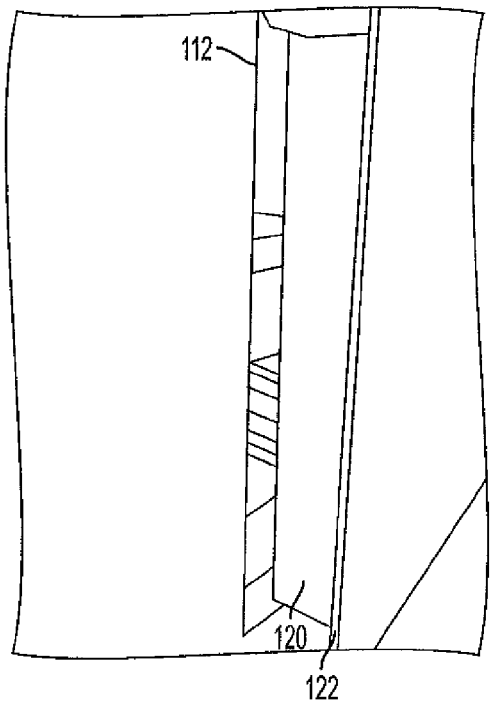
FIG. 5 is a side perspective view of a pop out panel fitting within an opening in the door of FIG. 1.
Figure 6:
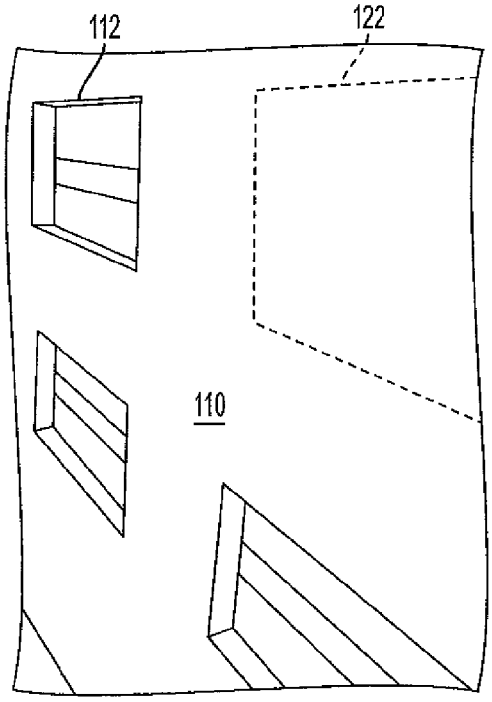
FIG. 6 is a front perspective view of the door of FIG. 1.
Figure 7:
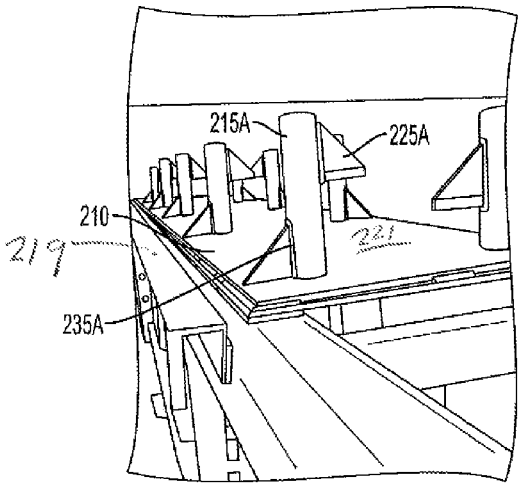
FIG. 7 is a side elevation view of a stanchion having pegs and gussets according to the embodiments described herein.
Figure 8:
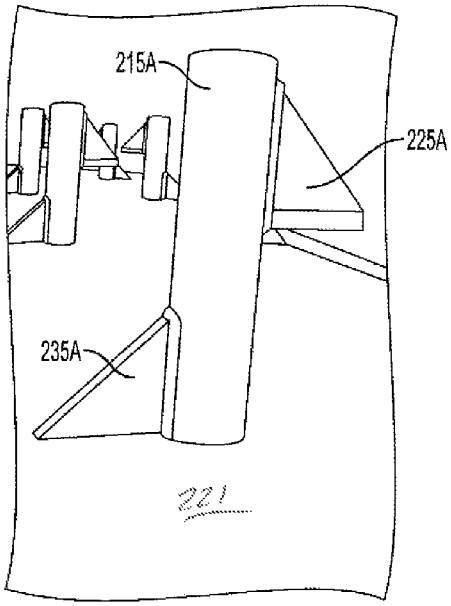
FIG. 8 is a close up view of one peg according to FIG. 7.

The supporting figures of this Detailed Description illustrate the method of assembling the barrier system according to the embodiments discussed above. FIGS. 1-4 illustrate an inner door (110) that is protected by an outer barrier assembly so that the first, or inner, door (110) maintains functionality in the event of an impact from a projectile or a severe weather emergency (i.e., a hurricane or tornado) causing a severe pressure differential across the structure (50). In FIGS. 1-4, the inner, or first, door (110) is the above described rollup door defining pressure relief openings (112) and supported by reinforcement beams (117). FIGS. 4-5 illustrate placement of a pop-out panel that covers the openings (112) in the door (110) in ordinary operation. The pop out panels attach across the pressure relief openings (112) by an adhesive engineered to give way at a known pressure differential across the door. FIG. 6 shows the door (110) with a pressure relief opening therein and a pop out panel (122) covering one of the openings in the door (110). Again, the door releases these panels when pressure across the structure supporting the door merits using a relief valve to maintain pressure, preventing an explosion and associated damage.

The system described above notes that the barrier assembly protecting inner door (110) is positioned on an opposite side of the structure (50) from the first door (110). Stanchions (210A, 210B) are positioned alongside an opening in the structure (50) to hold an outer barrier assembly along the structure or to place the barrier system in a desired location regardless of the structure. FIGS. 7-12 illustrate the details of the stanchions (210) described above and shown in FIG. 13 alongside the structure (50). The stanchions are each made with uprights (219) that are secured via a foundation (207) to hold an outer barrier assembly. The uprights connect to a plate (221) forming a face of the stanchion. The uprights (219), in turn, are reinforced by posts (215) that extend from outside the face of the stanchion into the body of the stanchion and connect to supporting members inside the stanchion. As shown in FIGS. 7, 8, and 10-12, the posts (215) are continuous solid rods of a material engineered to withstand a severe impact across the stanchion (210). In one embodiment, the stanchions (210), the plates (221) forming faces of the stanchions, and the posts (215) are all made of steel.

Figure 9:
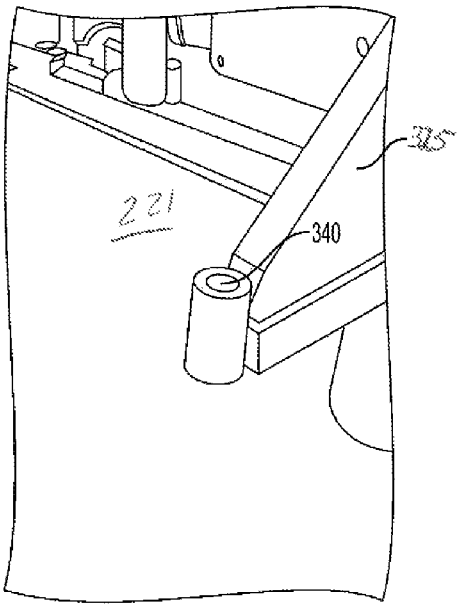
FIG. 9 is a close up view of one peg according to FIG. 7 defining an attachment mechanism on one gusset on the peg.
Figure 10:
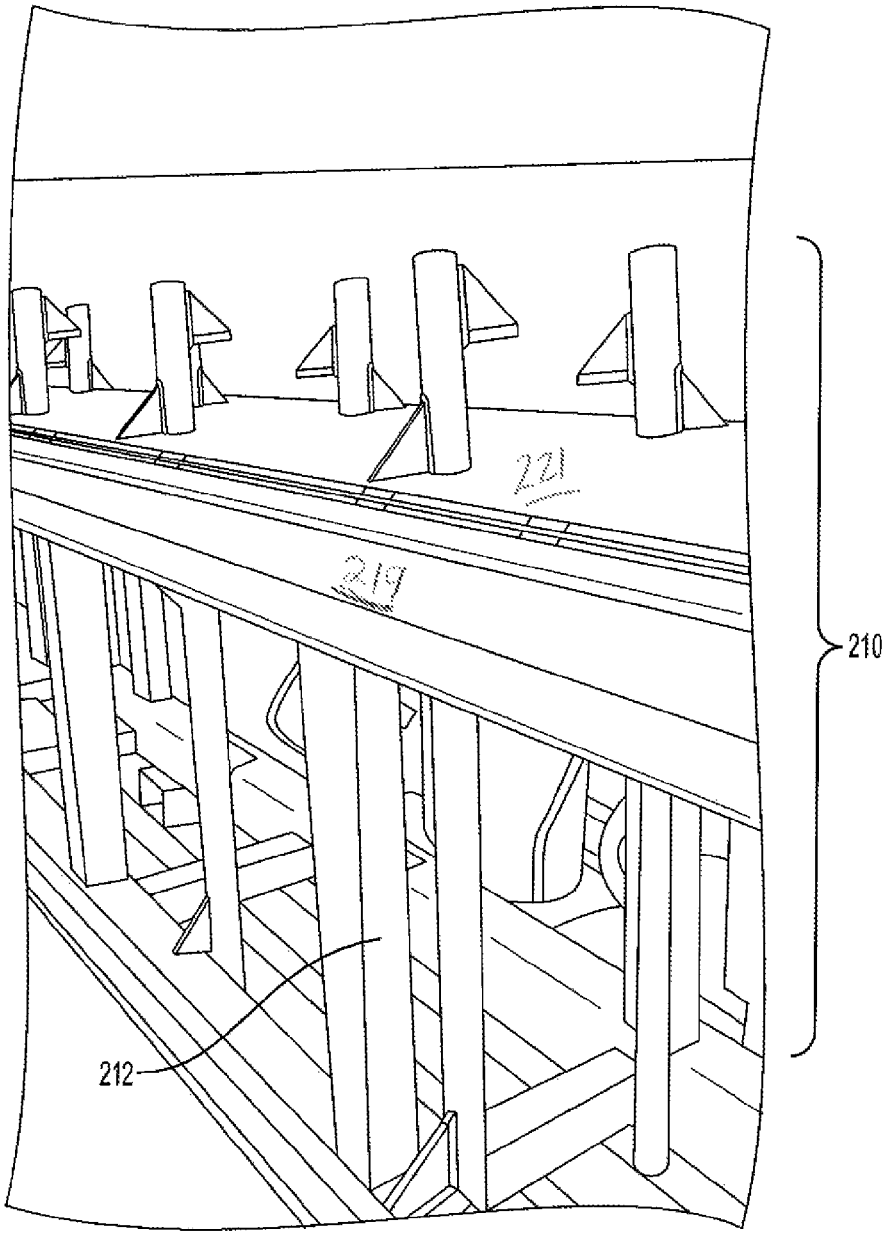
FIG. 10 is a side perspective view of a stanchion supporting the barrier assembly described herein.
Figure 12:
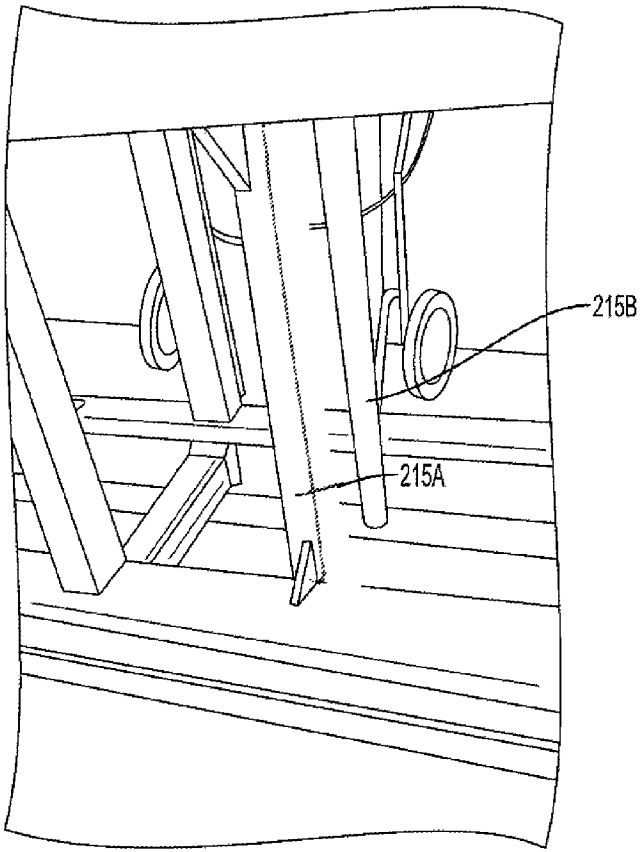
FIG. 12 is a side perspective view of a post supporting a stanchion connecting to a barrier assembly described herein.
Figure 11:
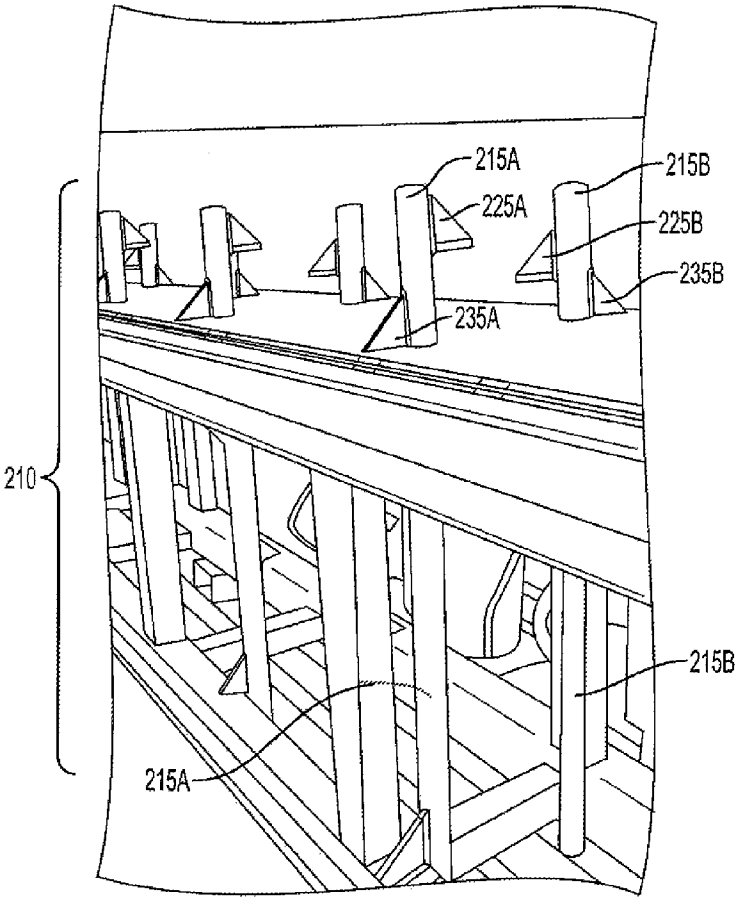
FIG. 11 is a side perspective view of a stanchion supporting the barrier assembly described herein.

FIGS. 7-10 illustrate that the posts (215) are positioned in the stanchions (210) to define pegs (215A) which are outer ends of the posts that project from the stanchion (210). The pegs (215A) are supported and reinforced by a first gusset (235A) that connects the peg (215A) to the stanchion (210). The peg also defines and/or connects to a second gusset (225A) used in the barrier assembly as described below. As shown in FIG. 9, the second gusset (225A, 325A) on an appropriate peg (215A) and positioned proximate a free end of the peg (215A), defines an attachment opening such as a threading (340) within the second gusset (325A). An attachment mechanism in this gusset is ultimately used to form a hinge on a stanchion as described below.

Figure 14:
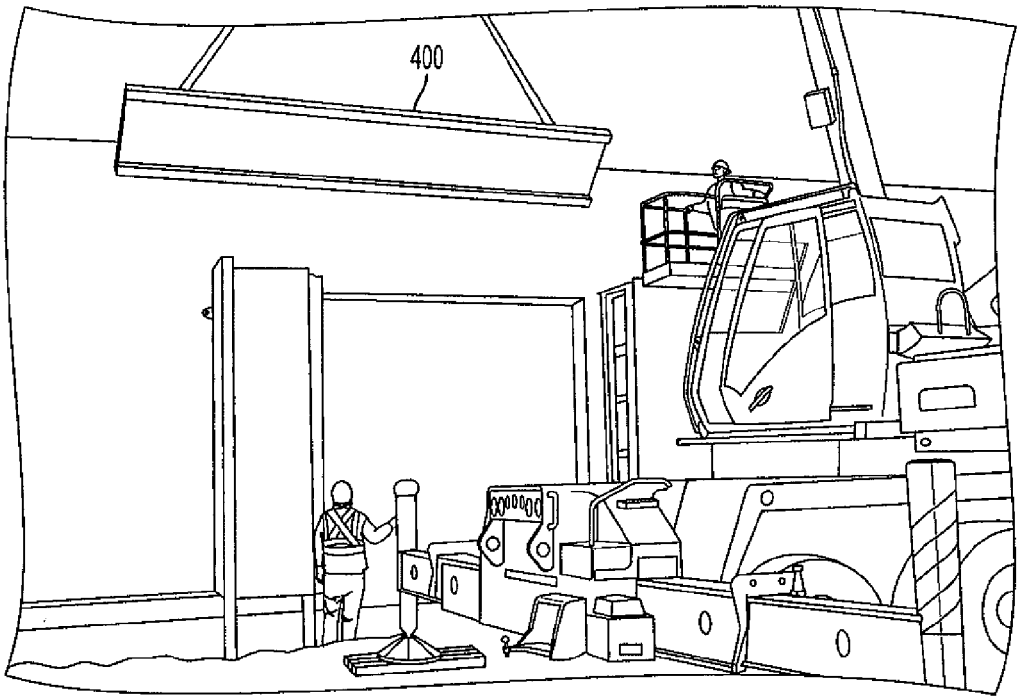
FIG. 14 is a front perspective view of supporting stanchions about an opening of a structure with the stanchions receiving a cap thereon.
Figure 15:
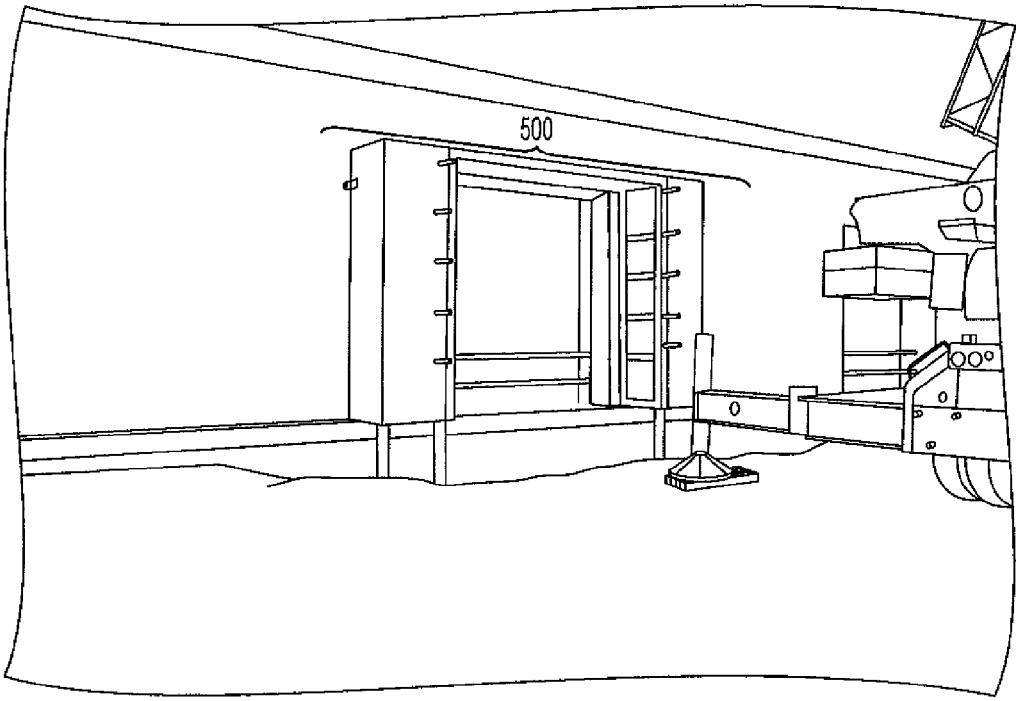
FIG. 15 is a front perspective view of a barrier support assembly of the embodiments described herein.
Figure 16:
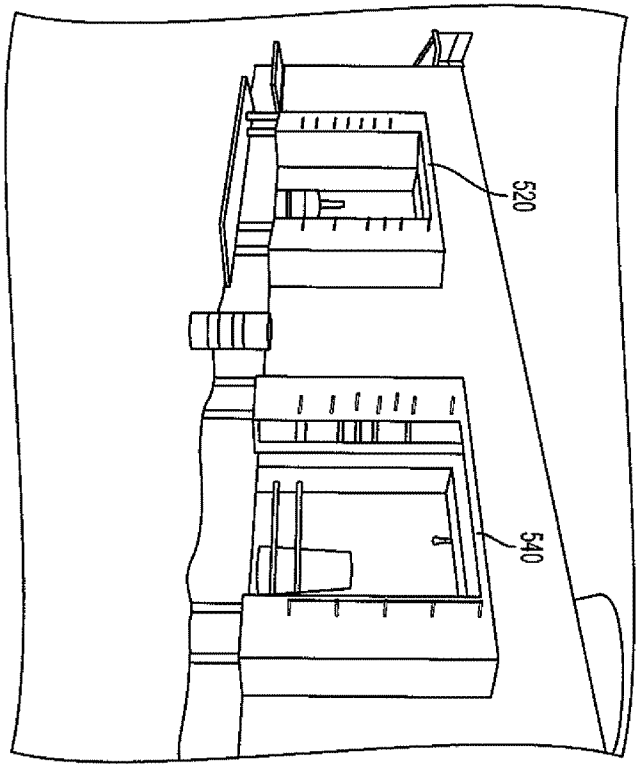
FIG. 16 is a front perspective view of a structure utilizing multiple instances of the barrier support assembly of FIG. 15.
Figure 17:
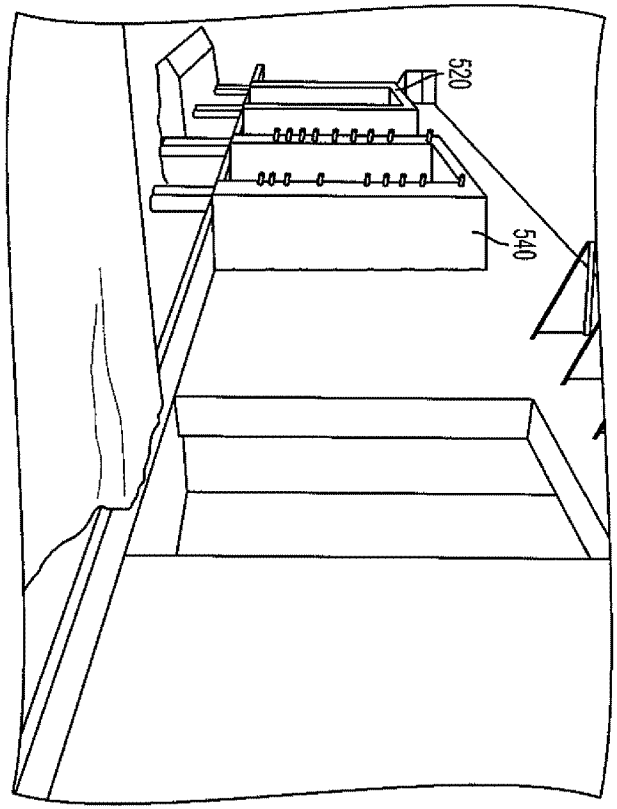
FIG. 17 is a front perspective view of a structure utilizing multiple instances of the barrier support assembly of FIG. 15.

FIG. 13 combines the components shown in FIGS. 1-12 in an assembly that includes the first door (110 of FIGS. 1-6) installed across an opening in a structure (50). FIG. 13 also illustrates a view of the stanchions (210A, 210B) positioned proximate a structure and supported by a foundation (207). The stanchions are characterized in part by the above noted pegs (215, 315) on respective stanchions installed on opposite sides of the opening having a first door (110). In the embodiment of FIG. 13, the first door (110) has pressure relief openings (112) shown with the pop-out panels (122) removed. The pop-out panels would be inserted across the openings (112) in normal operation in accordance with FIGS. 4-6. It is to be noted that one of the stanchions (210A) is considered a latching stanchion for the second door and protective fabric assembly while the other stanchion (210B) may be considered a hinged, or pivot, stanchion by which the second door and protective fabric assembly attach to pivot outwards toward the latching stanchion (210A). In this sense, the pegs (315) shown on the second (or opposite) stanchion (210B) include the gusset as shown in FIG. 9 by which the gusset (315A) defines an attachment mechanism for creating a hinging effect with the pivot stanchion (210B). FIGS. 14 and 15 illustrate construction of the stanchions, including a cap piece (400) that fits across the stanchions (210A, 210B) for even more stability and added strength to withstand an impact. As shown in FIG. 15, an outer barrier assembly (500) is capable of supporting the above described second door (600) and protection fabric (700) in accordance with the description of the embodiments herein. FIGS. 16 and 17 illustrate that a large structure such as a building might utilize numerous barrier assemblies in accordance with this description.

Figure 19:
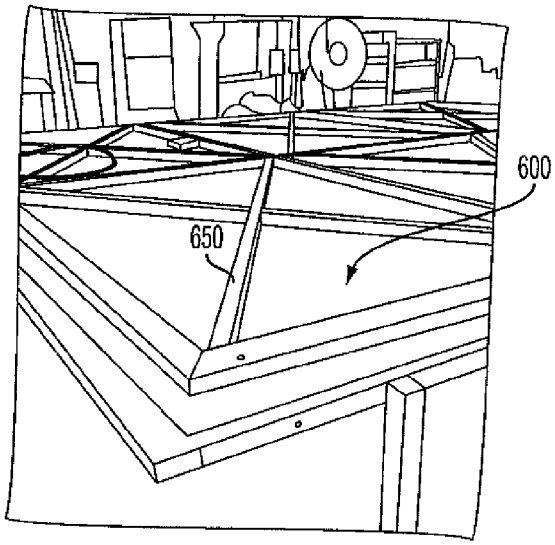
FIG. 19 is a top perspective view of the outer or second door of FIG. 18.

Beginning at FIG. 18, the second, or outer, door (600) is used as part of a first line of defense for incoming projectiles impacting a structure. The door (600) is manufactured of a material (e.g., steel) having sufficient strength to withstand forces of projectiles that must be deterred to protect the structure (50) and the inner, or first, door (110). The door may be reinforced with cross members (650) as shown in FIG. 19.

Figure 20:
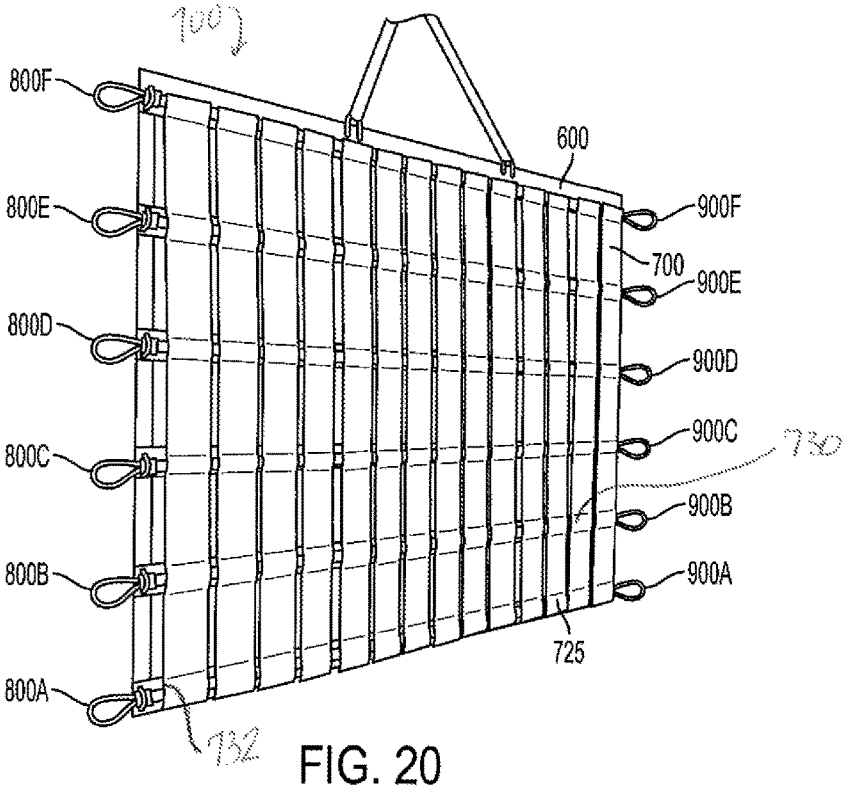
FIG. 20 is a front perspective view of a protection fabric described herein.
Figure 21:
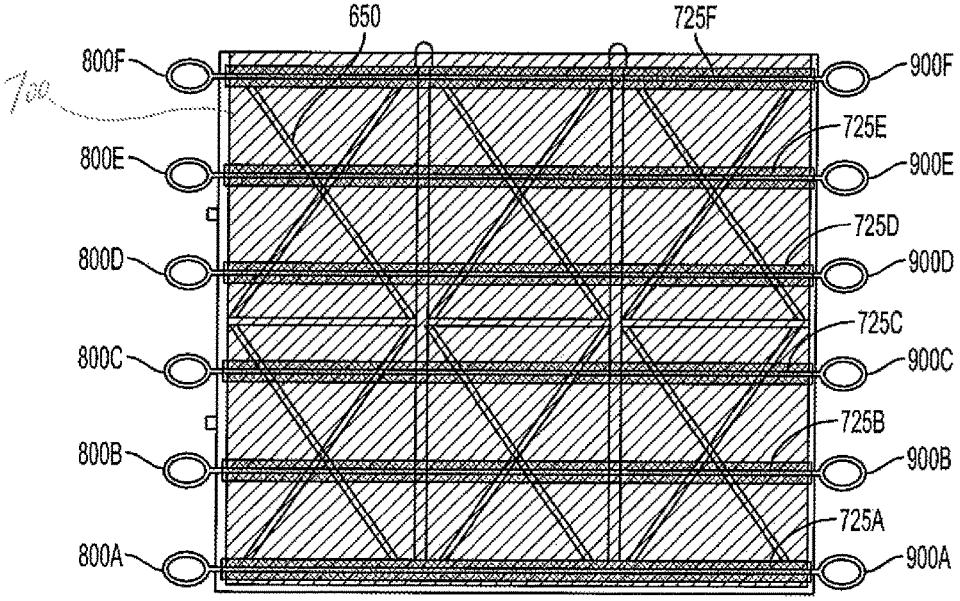
FIG. 21 is a front perspective view of a second or outer door of FIG. 18 engaging the protection fabric of FIG. 20.
Figure 22:
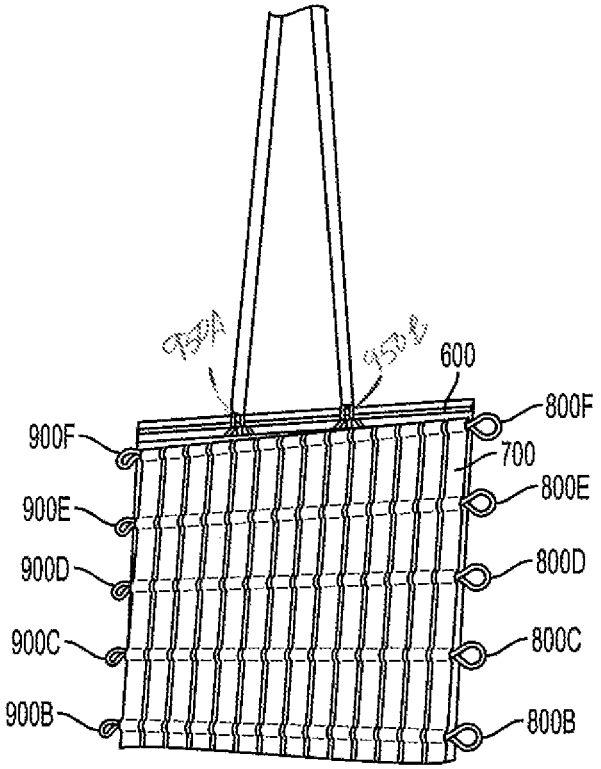
FIG. 22 is a front perspective view of a second or outer door of FIG. 18 engaging the protection fabric of FIG. 20 and lifted by lift rings.

The door (600) is only part of the outer defense system that connects to the barrier assembly (500) of FIGS. 13 and 15. The outer protection also includes a protection fabric (700) made of engineered textiles that can withstand impacts of projectile missiles. FIG. 20 shows the protection fabric having the above noted interference components (730) and beam components (725) forming the fabric (700). In the embodiment of FIG. 20, the beam components (725) terminate at opposite ends in the above note eyelets (800). In one embodiment the view of FIG. 20 would face the inner, or first, door (110). The view of FIG. 21 would face the outside. The door and the fabric are connected in one embodiment by clamps that bolt the fabric (700) to the door (600). FIG. 21 illustrates the system of eyelets (800A-F, 900A-F) that (i) form a hinge with a pivot side stanchion (210B) and (ii) can latch on a latch side stanchion (210A). In one embodiment, the latch side stanchions, as shown in FIG. 22 as stiffened eyelets (800A-F) include a reinforcement component, such as a strip of aluminum, to ensure that the eyelet retains its shape in a rigid fashion. On an opposite side of the fabric (700), the eyelets are flexible as shown by the shape of eyelets (900). In the embodiment of FIG. 22, the flexible eyelets (900) attach to the pivot side stanchion (210B) and stiffened eyelets (800) attach to the latch side stanchion (210A). In this way, the combination of the outer door (600) and the protection fabric (700) pivot about a hinging mechanism formed by flexible eyelets (900), a peg (315) on the stanchion (210B), a gusset (325) on the peg, and the attachment mechanism (340) of FIG. 9.

Figure 23:
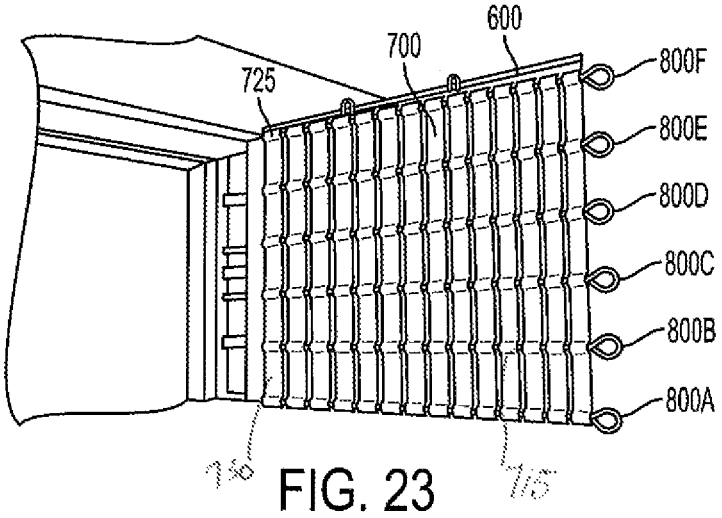
FIG. 23 is a front perspective view of a second or outer door of FIG. 18 engaging the protection fabric of FIG. 20 and hanging from a pivot side stanchion as described herein.
Figure 24:
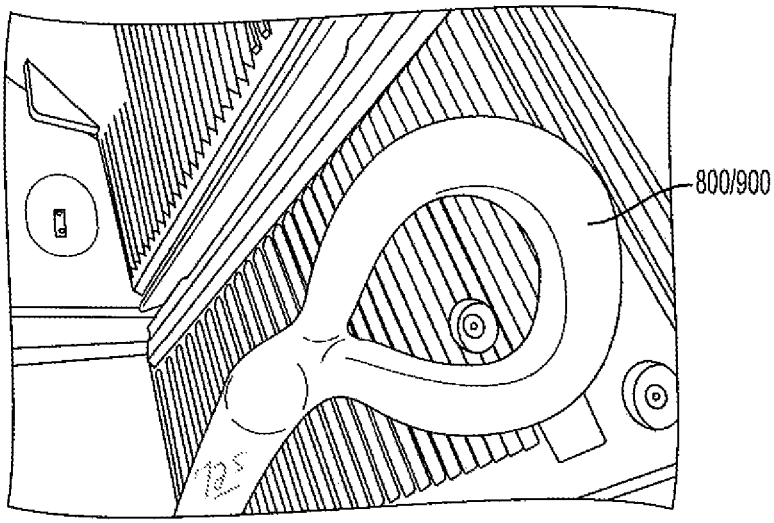
FIG. 24 is a top perspective view of a cable or beam member of the protective fabric of FIG. 20 terminating in an eyelet as described herein.
Figure 25:
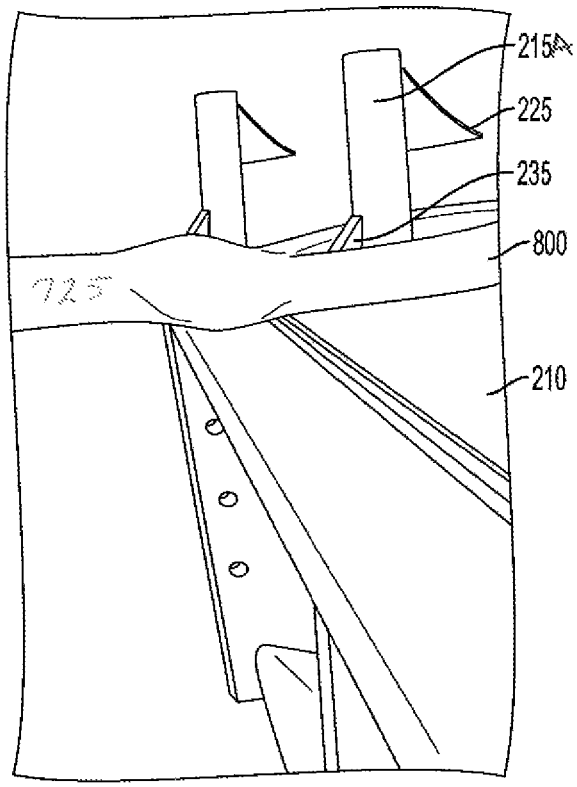
FIG. 25 is a side elevation view of the eyelet of FIG. 24 engaging a peg on a stanchion as described herein.
Figure 27:
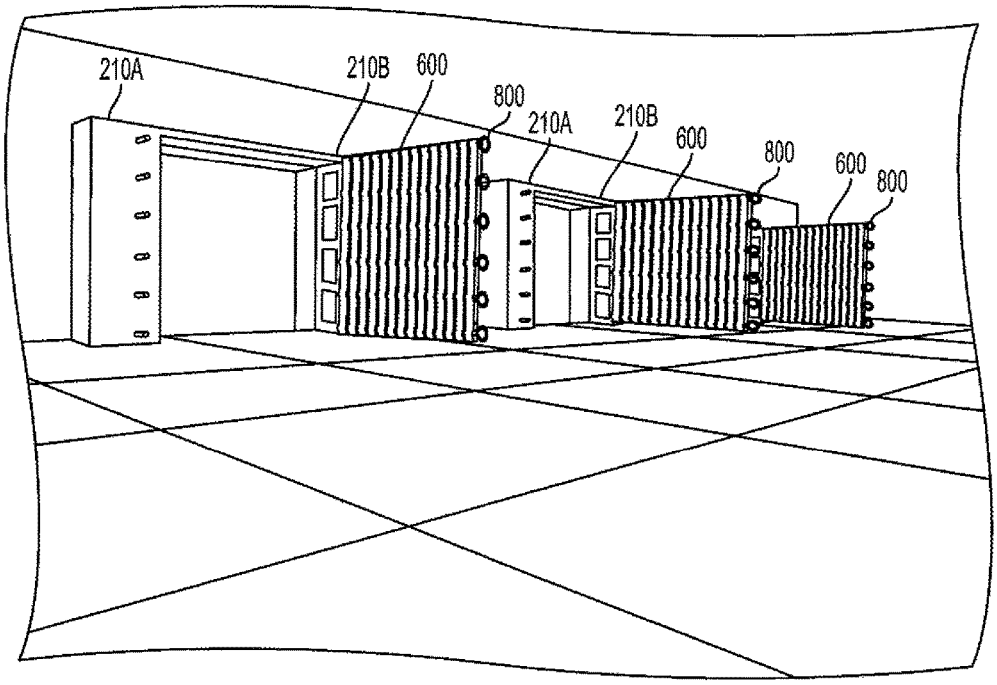
FIG. 27 is a side perspective view of a barrier system disclosed herein and installed in multiple instances in a structure as described herein.
Figure 28:
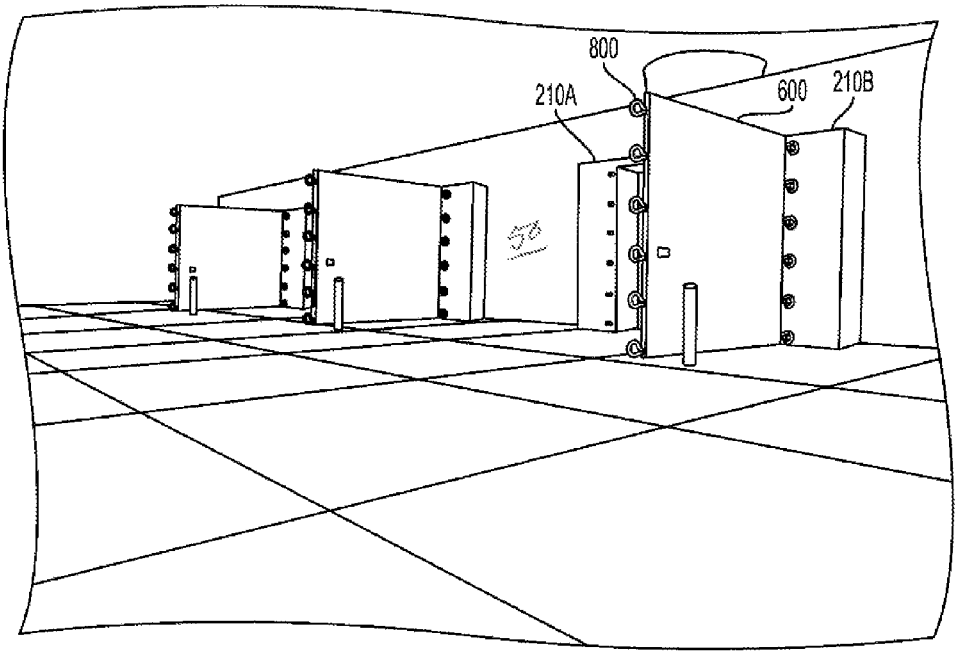
FIG. 28 is a side perspective view of a barrier system disclosed herein and installed in multiple instances in a structure as described herein.
Figure 29:
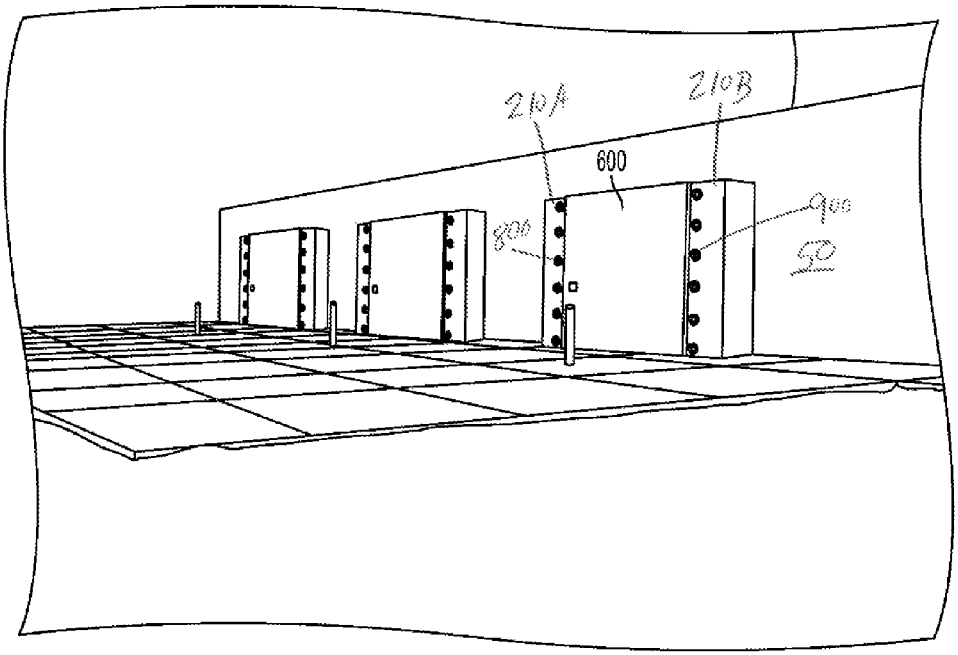
FIG. 29 is a side perspective view of a barrier system disclosed herein and installed in multiple instances in a structure as described herein.

As shown in FIGS. 22 and 23, the combination of the outer door (600) and the protection fabric (700) is lifted by lift rings (950) (i.e., by a crane or other mechanism) and positioned between the stanchions (210A, 210B). At this point, the eyelets (shown up close in FIG. 24) are attached in a particular sequence to appropriate pegs (215A) on a stanchion. FIG. 25 illustrates a non-limiting example of one of the eyelets (800) on the protective fabric (700) engaging a peg (215A) projecting from a stanchion (in this case stanchion 210A—the latch side stanchion). FIGS. 26 and 27 show perspectives of the outer barrier assembly (500) after the combination of the outer, or second, door (600) and the protection fabric (700) are installed. As noted in FIGS. 28 and 29, the outer door (600) pivots about one of the stanchions (210B) to close and latch onto the opposite stanchion (210A). FIG. 29 illustrates the closed assembly.

In regard to FIG. 29, upon closing the outer, or second, door (600), the structure (50) has a protected opening for ingress and egress even in the face of a projectile or missile destroying parts of the structure, the outer door (600), or the protection fabric (700) (positioned between the two doors in the closed configuration of FIG. 29. At the point in time shown in FIG. 29, a projectile would be stopped by one of (i) the physical dimensions of the stanchions (210) as supported by the covered foundation (207 of FIG. 13), or (ii) the protection fabric (700) on the inside of the second, or outer, door (600). In operation, and in conjunction with the disclosure of FIGS. 22 and 25, when a projectile does manage to breach the outer door (600), the protection fabric intercepts the projectile via the materials used in creating the fabric. The structure of both interception members (730) and beam members (725) allows the fabric to dissipate the energy of projectile impact to a far greater extent that simple steel. In this sense, the fabric (700) acts as a conduit for kinetic energy and dissipates that kinetic energy into the fabric (700), the stanchions (210), the pegs (215A), the posts (215) and uprights (219) of the stanchions, and the foundation (207) supporting the stanchions. With reference to FIGS. 25 and 26, upon impact, a projectile causes the beam members (725) to engage the pegs (215A) extending out of the stanchions and transfer impact energy to the stanchions via the pegs (215A). The pegs (215A) of course are actually ends of continuous posts (215) that extend across the body of the stanchions (210), allowing for even more energy absorption. The engagement of the eyelets (800, 900) and pegs (215) happens on both sides of the enclosure via respective stanchions. The protection fabric (700), therefore, has the ability to absorb the energy of impact in every direction due to the transverse nature of the straps (730) and cables (725) forming the fabric (700). Each cable (725) terminates in an eyelet along the height of the fabric, and each eyelet engages a stanchion via a respective peg.

Figure 30:
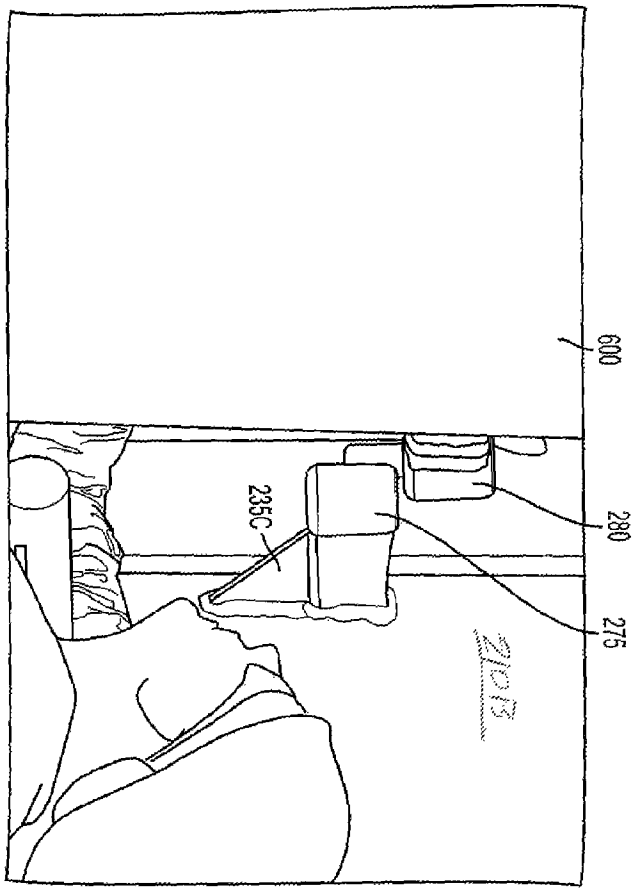
FIG. 30 is a side perspective view of an outer door and protection fabric combination in the process of attaching to a stanchion.
Figure 31:
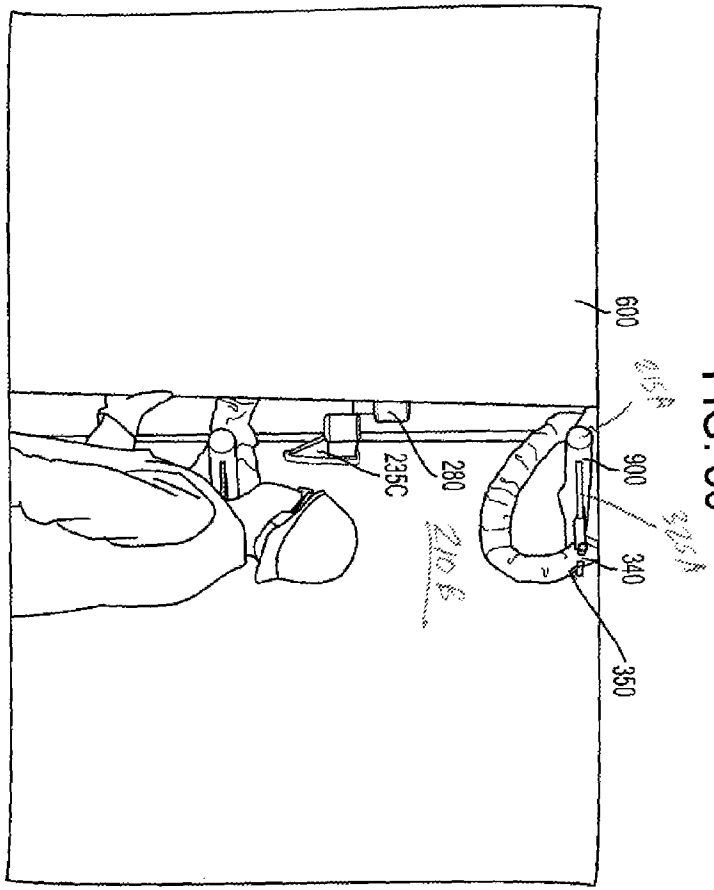
FIG. 31 is a side perspective view of the outer door of FIG. 30 in which an eyelet of the protection fabric engages and secures to the stanchion via the mechanism of FIG. 9.
Figure 32:
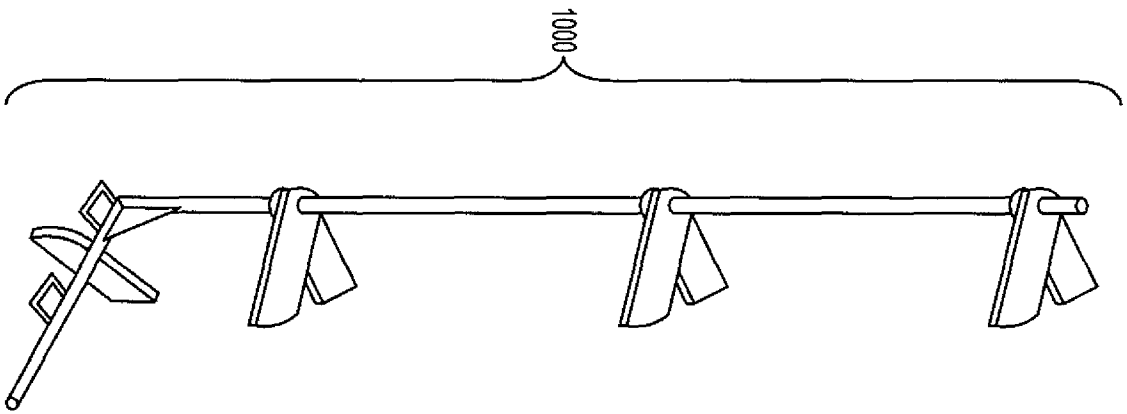
FIG. 32 is a plan view of a latching mechanism as described herein.

The protection fabric (700) and the eyelets (800, 900) formed at the termination points of the continuous beam members (725) serve to "hang" the outer door (600) as shown in FIGS. 30 and 31. In FIGS. 30 and 31, the pivot side stanchion is shown receiving a more flexible series of eyelets (900) on one side edge of the protection fabric. The outer door (600) is fitted with a hinging mechanism (275) receiving a companion post (280) to support the door on one of the stanchions serving as a pivoting side of the system. A peg (315A) extending from the stanchion (210B) engages a flexible eyelet (900), and the attachment mechanism shown in FIG. 9 (e.g. a threaded bore receiving a screw) secures the flexible eyelet in a hinged configuration to the pivot side stanchion (210B). This allows the outer door and protection fabric to swing outwardly to latch via more rigid eyelets (800) along pegs and gussets projecting from the other stanchion (210A). On the latch side stanchion (210A), the eyelets are ultimately surrounded by a gusset as showing in FIG. 25 and remain in a rest position until a force of impact from a missile causes the eyelet (800) to cinch tighter around a peg and gusset assembly described above. A locking assembly as shown in FIG. 31 may be attached to the latching side stanchion so that the outer door is secured in a closed position. In order to accommodate different grades of terrain across which the outer door and protection fabric must swing, the assembly may have an adjustable sweep plate along a bottom edge of the outer door (600) that can be adjusted up and down for varying clearance levels.

These and other aspects of the invention are set forth further in the claims below. Terms used in this disclosure are intended to be used in their broadest meaning.

The invention claimed is:

1. A barrier system preventing entry through a structure, the system comprising:

a first door positioned across an opening in the structure and on a first side of the structure;

a second door positioned across the opening and on a second side of the structure to define a separation between the first door and the second door;

a protection fabric extending over the second door such that the protection fabric is between the first door and the second door, wherein said protection fabric comprises at least one attachment eyelet along at least one edge of the protection fabric to attach the protection fabric to the structure;

wherein said protection fabric comprises interception members extending in one direction and beam members extending in a substantially perpendicular direction to said interception members; and wherein said protection fabric is attached to said second door by clamps extending over said beam members.

2. A barrier system according to claim 1, wherein said protection fabric comprises at least two eyelets positioned on opposite edges of said protection fabric.

3. A barrier system according to claim 2, wherein at least one of said eyelets comprises a stiffening member retaining the shape of the eyelet.

4. A barrier system according to claim 1, wherein said interception members are straps and said beam members are cables.

5. A barrier system according to claim 1, wherein said interception members and said beam members are connected in a weave forming the protection fabric.

6. A barrier system according to claim 1, wherein said interception members and said beam members are connected in a net configuration.

7. A barrier system according to claim 1, wherein said interception members define respective loops through which said beam members extend.

8. A barrier system according to claim 1, wherein said beam members terminate in said eyelets on at least one end.

9. A barrier system according to claim 1, wherein said clamps are bolted to said second door.

10. A barrier system according to claim 1, wherein said second door is a steel plate door comprising reinforcement cross members of steel.

11. A barrier system according to claim 1, wherein said first door is a retractable door on a track connected to the structure.

12. A barrier system according to claim 1, wherein said second door connects to the structure by at least one stanchion.

13. A barrier system according to claim 12, wherein said stanchion comprises uprights connecting at least one plate member along the uprights.

14. A barrier system according to claim 12, wherein said stanchion comprises a post member extending through said plate member into said stanchion, said post member defining a peg extending from said plate member.

15. A barrier system according to claim 14, wherein said post member attaches to respective uprights on opposite sides of said stanchion.

16. A barrier system according to claim 14, wherein said peg is supported by a first gusset connected to said plate member.

17. A barrier system according to claim 16, further comprising a second gusset connected to said peg at an end of said peg opposite said first gusset.

18. A barrier system according to claim 14, wherein said stanchion connects to the exterior of the structure proximate the opening and said peg receives one of said eyelets across the peg to support said protective fabric on the second door.

19. A barrier system according to claim 1, wherein said first door defines pressure openings receiving pop out panels removably positioned within said pressure openings.

20. A barrier system according to claim 19, wherein said panels attach to said first door by a tether.

21. A barrier system according to claim 20, wherein said tether is a hinge.

22. A barrier system according to claim 19, wherein said panels fall out of said pressure openings upon a pressure differential across the first door.

23. A barrier system according to claim 19, wherein said panels connect to said first door along lips attached to said first door via an adhesive.

24. A barrier system according to claim 23, wherein said adhesive releases said panels when the pressure differential across the first door is greater than 5 pounds per square feet.

25. A barrier system according to claim 22, wherein the pressure differential across the first door is between about 5 pounds and about 30 pounds per square feet.

26. A barrier system positioned across an opening in a structure, comprising:

at least a first stanchion defining at least one peg extending from the stanchion;

a protective fabric extending across the opening and connected to the first stanchion by an eyelet attached to a first edge of the protective fabric, the protective fabric also attached to the structure at a second edge of the protective fabric opposite the first edge;

a second stanchion connecting the protective fabric to an opposite side of the opening, wherein said protective fabric comprises a pair of eyelets on the first and second edges; and wherein each of the eyelets engage a respective peg on a respective stanchion;

an outer door supporting said protective fabric across the opening; and wherein said protection fabric is attached to said outer door by clamps extending over said beam members.

27. A barrier system according to claim 26, further comprising:

a second stanchion connecting the protective fabric to an opposite side of the opening, wherein said protective fabric comprises a pair of eyelets on the first and second edges, and wherein each of the eyelets engage a respective peg on a respective stanchion.

28. A barrier system according to claim 26, wherein said clamps are bolted to said outer door.

29. A barrier system according to claim 26 wherein said outer door is a steel plate door comprising reinforcement cross members of steel.

30. A barrier system according to claim 26, wherein said protection fabric comprises interception members extending in one direction and beam members extending in a substantially perpendicular direction to said interception members.

31. A barrier system according to claim 30, wherein said interception members are straps and said beam members are cables.

32. A barrier system according to claim 30, wherein said interception members and said beam members are connected in a weave.

33. A barrier system according to claim 30, wherein said interception members define respective loops through which said beam members extend.

34. A barrier system according to claim 26, wherein said beam members terminate in said eyelet on at least one end.

35. A barrier system comprising:

a first stanchion defining at least one peg extending from said first stanchion;

a second stanchion defining at least one opposite peg extending from said second stanchion a protective fabric extending between said first and second stanchions, said protective fabric comprising at least one eyelet along at least one edge of said protective fabric, wherein the protective fabric is connected to both stanchions, and wherein said protective fabric is connected to at least one of said stanchions by said eyelet engaging either said peg or said opposite peg;

wherein said protective fabric comprises interception members extending in one direction and beam members extending in a substantially perpendicular direction to said interception members; and wherein said protection fabric is attached to said door by clamps extending over said beam members.

36. A barrier system according to claim 35, wherein said pegs are supported by respective first gussets connecting said pegs to a respective stanchion.

37. A barrier system according to claim 35, further comprising respective second gussets connected to said pegs at an end of each respective peg opposite said respective first gussets.

38. A barrier system according to claim 35, wherein said second gusset of said opposite peg defines an opening to receive an attachment mechanism connecting said second gusset to said second stanchion.

39. A barrier system according to claim 38, wherein said second gusset of said second opposite peg defines a latch for receiving and securing said eyelet between said attachment mechanism and second gusset.

40. A barrier system according to claim 39, wherein said protective fabric comprises at least first and second eyelets on opposite edges of said protective fabric, said first eyelet engaging said peg on said first stanchion and said second eyelet engaging said latch on said second stanchion.

41. A barrier system according to claim 35, wherein said interception members are straps and said beam members are cables.

42. A barrier system according to claim 35, wherein said interception members and said beam members are connected in a weave.

43. A barrier system according to claim 35, wherein said interception members and said beam members are connected in a net configuration.

44. A barrier system according to claim 35, wherein said interception members define respective loops through which said beam members extend.

45. A barrier system according to claim 35, wherein said beam members terminate in said eyelets on at least one end.

46. A barrier system according to claim 35, wherein each respective beam member defines an eyelet at opposite ends of the beam members.

47. A barrier system according to claim 35, wherein said clamps are bolted to said outer door.

48. A barrier system according to claim 35, wherein said outer door is a steel plate door comprising reinforcement cross members of steel.

49. A barrier system according to claim 35, wherein said eyelet comprises a stiffening member retaining the shape of said eyelet.

* * * * *